US005205229A

United States Patent [19]

Job

[11] Patent Number: 5,205,229

[45] Date of Patent: Apr. 27, 1993

[54] TUFTING PROCESS, AND A DEVICE FOR IMPLEMENTING SAID PROCESS

[75] Inventor: Pierre G. E. Job, Dison, Belgium

[73] Assignee: Societe Anonyme des Ateliers Houget Duesbeg Bosson, Verviers, Belgium

[21] Appl. No.: 781,895

[22] Filed: Oct. 24, 1991

[30] Foreign Application Priority Data

Oct. 26, 1990 [BE] Belgium ..... 90001018

[51] Int. Cl.[5] ..... D05C 15/30

[52] U.S. Cl. ..... 112/80.41; 112/80.53; 112/80.3

[58] Field of Search ..... 112/80.01, 80.18, 80.3, 112/80.4, 80.41, 80.5, 80.52, 80.24, 80.7, 266.2, 80.53, 80.33

[56] References Cited

U.S. PATENT DOCUMENTS 2,528,392 10/1950 Self .
3,091,199 5/1963 Ballard .
3,596,617 8/1971 Watkins ..... 112/80.41
3,934,524 1/1976 Smith ..... 112/80.3 X

FOREIGN PATENT DOCUMENTS 2834723 3/1979 Fed. Rep. of Germany ... 112/80.41
1310850 10/1962 France .
2041975 1/1971 France .
1173238 12/1969 United Kingdom .

*Primary Examiner*—Clifford D. Crowder
*Assistant Examiner*—Paul C. Lewis
*Attorney, Agent, or Firm*—Zarley, McKee, Thomte, Voorhees & Sease

[57] ABSTRACT

The process consists of a cloth being let off at a variable speed between each stitch or to maintain the cloth in a fixed position, the hooks being moved in synchronism with the needles. The device consists of a frame bearing needles, a frame bearing hooks, a variable speed motor for letting off a woven cloth, a motor and linkage for stitching the needles bearing the thread through the cloth, and a cam and connected rockers for holding the thread which passes through the cloth, a stepper motor for letting off the cloth at a variable speed, and a motor and gear for moving the hook frame in synchronism with the needle frame.

2 Claims, 6 Drawing Sheets

TUFTING PROCESS, AND A DEVICE FOR IMPLEMENTING SAID PROCESS

BACKGROUND OF THE INVENTION

The present invention concerns a process for tufting, and a device for implementing said process.

The technique of tufting, which is used in particular in the production of floor carpeting, consists of stitching needles linearly through a woven cloth, where said needles carry the thread, which is held by pivoting hooks during each stitch, and where said hooks and needles are situated on either side of the woven cloth. The cloth let-off operates continuously and regularly.

In the known devices, the needles and the hooks are placed in series in modules which together make up the needle frame and the hook frame respectively. In order to be able to form designs, the needle frame can move along its longitudinal axis with respect to the (transverse) direction of advance of the cloth, but the hook frame remains fixed.

The movement of the needle frame is limited, given that for each stitch every needle has to have a hook opposite it. The movement of the needle frame depends on the distance between two successive needles (known in the tufting technique as the gauge), and must correspond to one gauge or a multiple thereof.

This means that the only stitches possible with a needle frame are:

- linear stitching, without movement of the needles;
- zigzag stitching, with the needles being moved in steps of one gauge;
- double zigzag stitching, provided that the machine is equipped with a second needle frame parallel to the first;
- linear stitching with a to-and-fro movement of the cloth.

Another possibility is to change the pitch of the gauge, but changing from one gauge to another requires changing and adjusting the needle frames and hook frames. Furthermore, changing the gauge requires adjusting the controls, cams, hydraulics, etc. These adjustments are long and dull, so much so that tufting looms are generally left idle when the mill is not producing the gauge and height of tuft for which they are set.

The present invention has as its aim to offer a tufting process and a device for implementing said process which avoids the disadvantages mentioned.

Another aim of the invention is to offer a process and a device for implementing said process which enables a large number of designs to be made.

Yet another aim of the invention is to offer a tufting process which makes possible movements of the needles independently of the gauge.

SUMMARY OF THE INVENTION

According to a first characteristic of the process according to the invention, the hooks are moved in synchronization with the needles such that each needle forms a pair with its hook. The synchronous movement of a needle with its hook makes possible variable movements with a value independent of the gauge. Furthermore, each pair (needle-hook) can be permanently adjusted and set before the device is put into operation.

According to another characteristic of the invention, the woven cloth is let off at a variable speed, thus making possible variations in the designs. The cloth let-off is preferably stopped during the action of stitching. The cloth let-off can also be advantageously stopped during certain movements of the pairs (needles-hooks) in such a way that all the stitches in the same longitudinal plane (with reference to the transverse direction of advance of the cloth) can be carried out by the same pair.

The fact that each needle is always located opposite the same hook, whatever their position, makes possible long longitudinal displacements without limitations on the needles, which combined with the cloth stop or let-off control, gives greater possibility for transfer of colour or design. This technique makes it possible to "break" the effect of repetitive alignment of the carpet loops in the direction of the weft.

Numerous stitching possibilities become possible, including those which involve the needles and their respective hooks moving to the right or left in variable steps.

This advantage also enables the number of needles and hooks to be varied; many more designs with fewer pairs (needles-hooks) become possible. The distance between the needles can be chosen according to the size of the design, the required production and the rotation of the different qualities to be tufted.

For the same type of needle chosen, different designs can be programmed with different gauges and densities. Colour changes can be done using creels.

According to another characteristic of the invention, it is possible to use needles with a flat part, known as the blade, bearing the needle eye, with the needles mounted in modules where the longitudinal axis (of each needle) is turned so that the blade forms an angle with the plane vertical to the direction of the cloth let-off.

This angle is preferably between 15° and 45°. Further, the hooks are also mounted in modules so that the oscillating movement of each hook forms the same angle as that of the needle with which it is paired.

This characteristic enables the thread to be kept away from the point of the needle, so as to prevent stitching over it.

According to another characteristic of the invention, during stitching the cloth is let off in a vertical plane, and the needle frame and hook frame are placed in a horizontal plane on either side of the cloth.

As a result of the longitudinal positioning of the needles not being limited by the gauge, it is no longer possible to use a cloth support comb; however, its use is not necessary, since according to another characteristic of the invention, a smooth support and a continuous tensioner are used, enabling the stitching to be controlled without having to use a device similar to a predetermined gauge comb.

DESCRIPTION OF THE DRAWINGS

The invention is described below in detail with reference to drawings which represent the examples of embodiment, where.

DESCRIPTION OF THE PREFERRED EMBODIMENT

Figure 1:
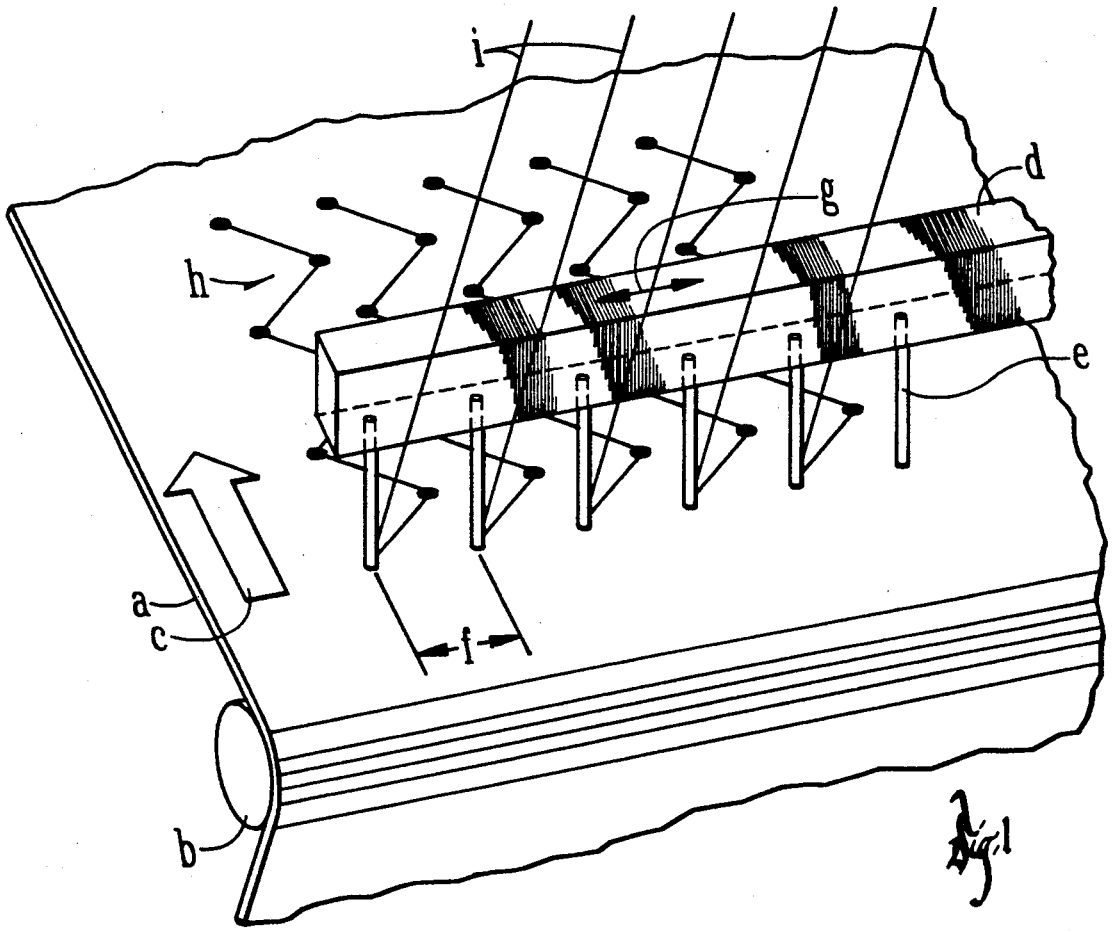
FIG. 1 is a schematic diagram of a tufting process g to the state of the art.

FIG. 1 shows schematically the stitching system according to the state of the art, with a wovencloth (a) which is let off from a roll (b) and which is located in a horizontal plane (arrow c) below a frame (d) whose axis is perpendicular to the direction of let-off of the cloth (a). The frame (d) carries needles (e) according to a fixed gauge (f). Said frame (d) can move with a to-and-fro motion (arrow g) permitting a zig-zag pattern (h). The thread (i) is supplied from a battery of bobbins (not shown). The hooks, which are fixed-mounted on a hook frame, are located below the cloth and are not visible in the diagram. Since the tissue is let off in a regular fashion and the needles (a) can only move in steps of the gauge (f), because the hooks are fixed, and since the needles (e) must always be opposite a hook, the design cannot be in a line if th frame (d) does not move or in a zig-zag (h) if the needle frame (d) moves in gauge steps (f) with a to-and-fro motion (g).

Figure 2:
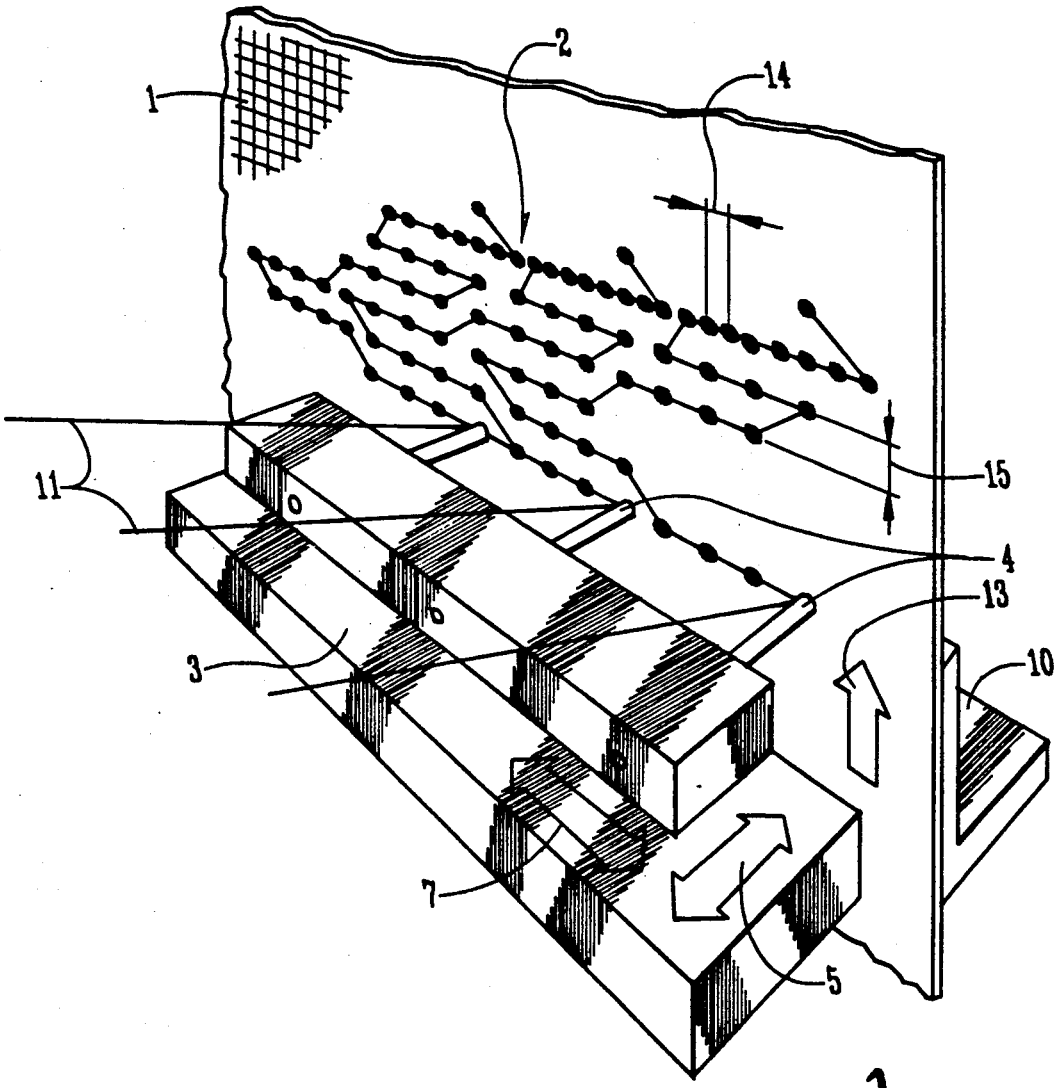
FIG. 2 is a schematic diagram of a tufting process according to the invention.
Figure 3:
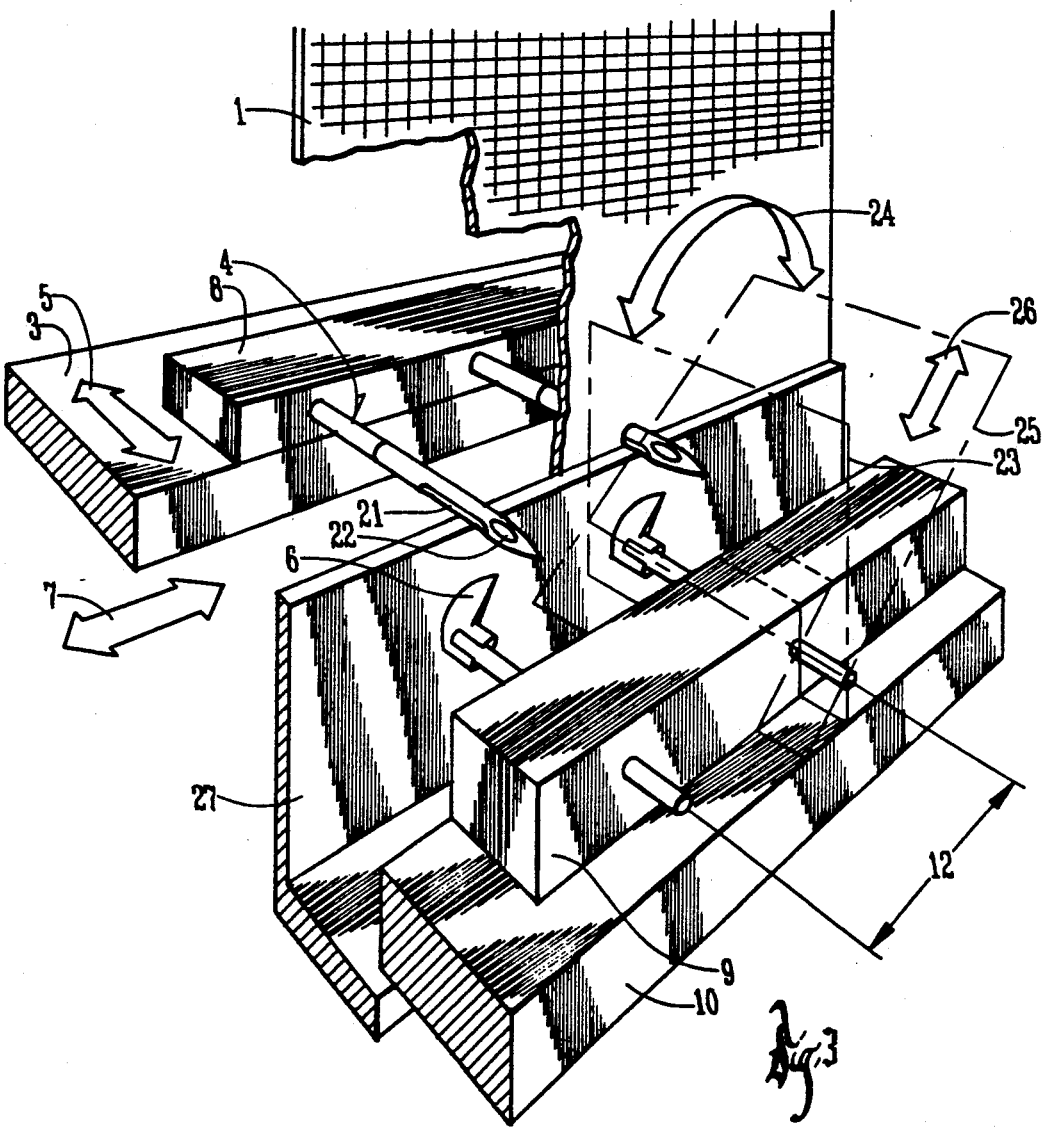
FIG. 3 is a perspective view of the tufting zone in an example of embodiment of the invention.

FIG. 2 is a schematic diagram of the same type as FIG. 1, but according to the technique of the invention. A woven cloth 1 is let off in a vertical plane (arrow 13) between a frame 3 bearing needles 4 and a frame 10 bearing hooks 6 (FIG. 3). The needles 4 carrying the thread 11 are arranged in modules 8 on the frame 3, and similarly the hooks 6 are arranged in modules 9 on the frame 10.

According to a characteristic of the invention, the cloth 1 moves in a variable way so that the distance 15 between two neighboring stitches in a distinct horizontal plane is also variable, depending on the variation in movement of the cloth.

According to the invention, the hooks 6 move in synchronism with the needles 4, and there is no longer any reason to have uniform gauges; the distance 14 between two neighboring stitches in the same horizontal plane can therefore also be variable. The arrows 5 and 7 represent respectively the direction of stitching and the direction of horizontal positioning of the needles 4. From FIG. 2, it can clearly be seen that the design 2 obtained can be complex and have almost unlimited variation.

In the example shown in FIG. 3, the same elements as in FIG. 2 have the same reference numbers. This Figure shows the particular positioning of the needles 4 and the hooks 6. The needles 4 have a flattened part 21, called the blade, bearing the eye 22 through which passes the thread 11. The longitudinal axis of each needle is turned so that the blade 21 forms an angle 24 with the vertical plane 23 (in the direction of advance 13 of the cloth), where said angle is 30° in the example under consideration. The part of the hooks 6 which holds the thread 11 forms with the vertical plane 23 and an identical angle 24 of 30°, the represented in FIG. 3 by the plane 25. This plane 25 also illustrates the crossing angle of the needle with its hook. The arrow 26 represents the movement of the hooks 6. The spacing 12 between two neighboring hooks (and two neighboring needles) is not fixed and can have multiple gauges. The element 27 constitutes the structure for supporting the tissue. Together with the tension roller 28 and the cloth pressing element 29 (FIG. 4) it forms the device for keeping the woven cloth 1 under continuous tension.

Figure 4:
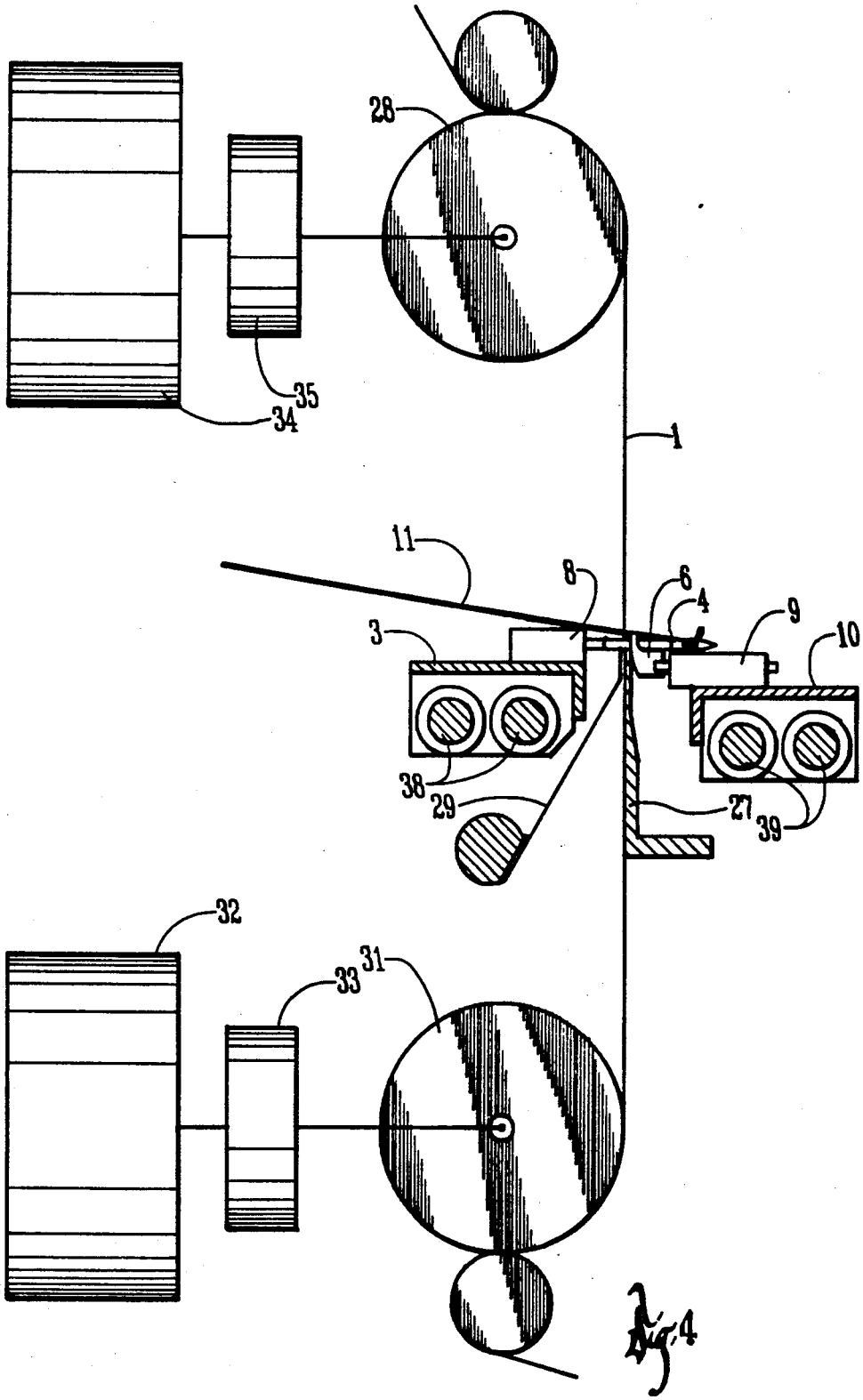
FIG. 4 is a schematic vertical cross-section of the example in FIG. 3.

FIG. 4 shows an example of let-off of the woven cloth 1. The cloth comes from a storage roller, passes a delivering cylinder 31 driven by a stepper motor 32 which drives the cloth let-off and which is equipped with an electromechanical locking system 33 for stopping the cloth. This system 32–33 enables the woven cloth to be stopped during stitches, and enables the let-off to be controlled with variable steps. The cloth 1 is tension in the stitching zone by means of the tension cylinder 28 driven by a continuous tensioning motor 34 equipped with an electromagnetic clutch 35 for regulating the tension. In the stitching zone the cloth passes the support structure 27 and the cloth pressing element 29.

A conventional, digital electronic apparatus for controlling the machine is used for general control of the loom. Said apparatus must enable the frames to be positioned longitudinally, and must enable the cloth let-off to be controlled at a speed such that stitching can be carried out at, for example, 600–700 stitches per minute. It also controls the automatic settings of the different tufting parameters: needle travel, loop height, thread delivery, thread tension and cloth tension. This conventional electronic apparatus is known to persons versed in the art, and its embodiment does not come within the scope of the invention.

An example of longitudinal guiding of the needle frame and the hook frame is shown in FIG. 4 by references 38 and 39, respectively, and is described in greater detail below.

The arrangement of the different elements and in particular the vertical let-off of the cloth makes it possible for the bobbins of thread (11) to be accommodated in the base of the machine, which is not possible with a horizontal cloth let-off. The important elements, such as needles and hooks, are thereby made more accessible, and ht machine is easier to control.

Figure 5:
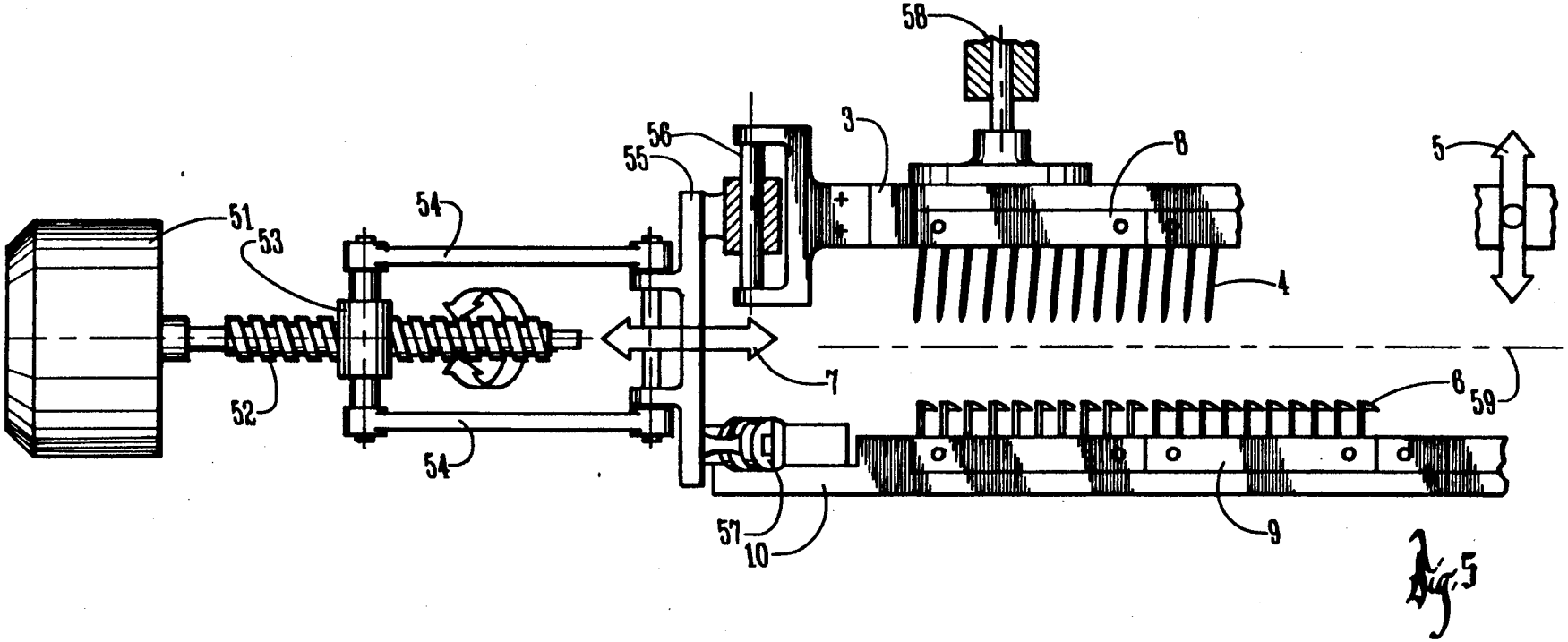
FIG. 5 is a plan view of an example of a device for synchronous positioning of the needle and hook frames.
Figure 6:
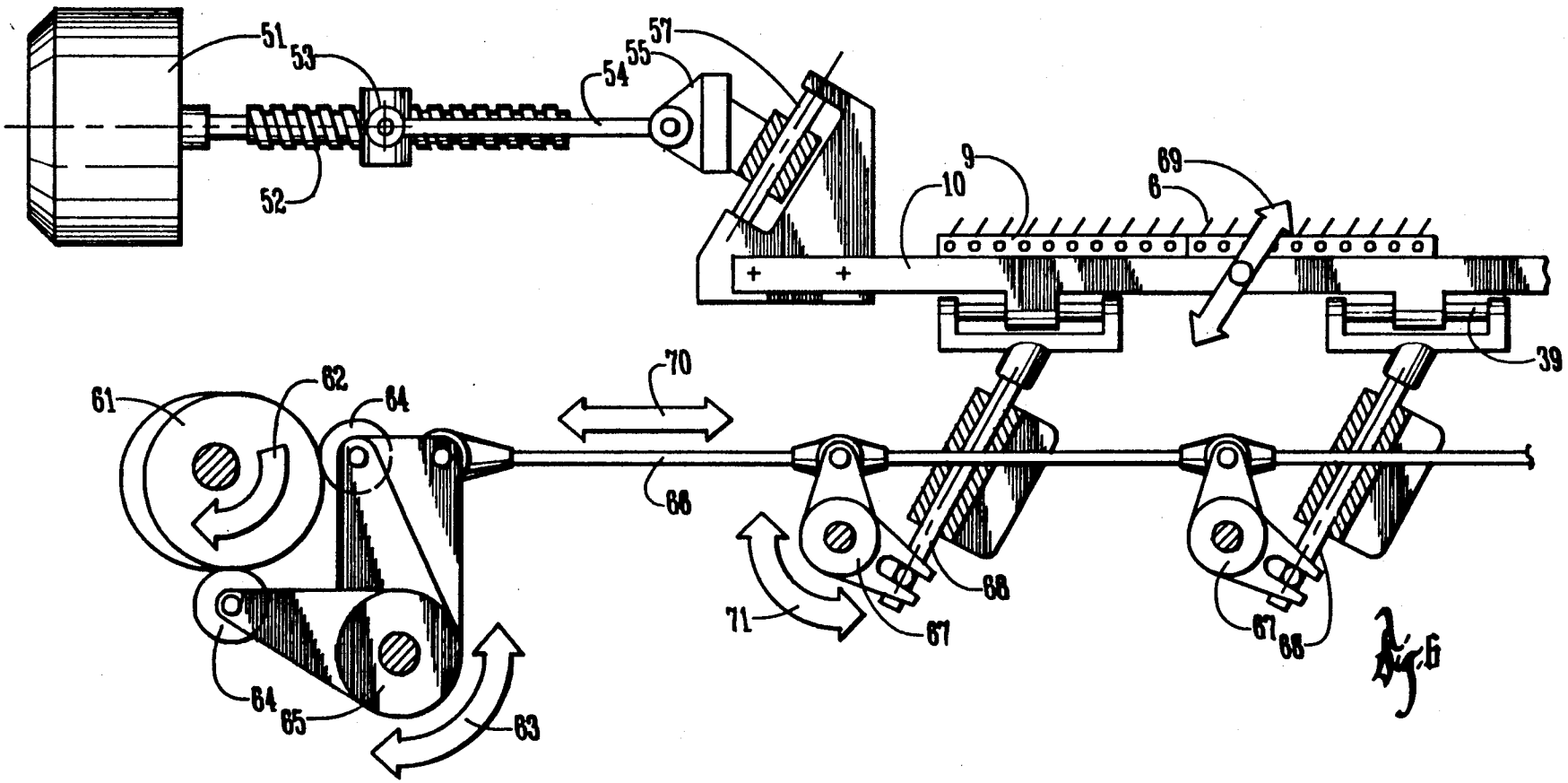
FIG. 6 is a profile view of part of the device according to FIG. 5, showing the movement of the hooks.

FIGS. 5 and 6, which describe an example of positioning of the needle and hook frames and of their movement, shows a stepper drive motor 51 which turns a worn 52 bearing a nut 53, linked by a pivot-pin rod 54 to the yoke 55 which is linked to the frame 3 bearing the needles 4 by means of a guide connector 56 and which is linked to the frame 10 bearing the hooks 6 by means of a guide connector 57. The guiding of the movement of the needles 4 is shown schematically by the broken line 58, while reference 59 indicates the plane of the woven cloth 1.

FIG. 6 shows schematically the movement 69 of the hooks 6. This movement is controlled by a twin cam 61 which turns (arrow 62) and rocks (arrow 63) a rocker 63 by means of rollers 64 pressing against its smooth outline. This movement 70 is transmitted by the connecting rod 66 to intermediate rockers 67 (two of which are shown) whose movement 71 determines the guiding 68 of the movement 69 of the hooks 6. The longitudinal guiding of the hook frame 10 is shown by reference 39, and the longitudinal guiding of the needle frame 3 is shown in FIG. 4 by reference 38. The device enables the frames 3 and 10 to be positioned with an accuracy of less than 0.1 mm.

It is clear that the invention is in no way limited to the embodiment described in the example and in the Figures. It is up to persons versed in the art to use the known mechanism to, for example, achieve the synchronism of movement between the needle modules and hook modules, sinc this movement can be obtained in many ways. Similarly, there are many possibilities for regulating and controlling the irregular cloth let-off.

The combination of variable cloth let-off with the movement of needle and hook frames also falls within the field of conventional mechanics and electronics.

I claim:

1. A tufting device comprising:

a needle frame bearing needles;

a hook frame bearing hooks;

means for advancing a woven cloth between the needle frame and the hook frame;

means for stitching the needles carrying thread through the cloth;

means for pivoting the hooks so as to hold the thread passing through the cloth and operating simultaneously with the means for stitching;

means for advancing the cloth at variable speed and to maintain the cloth in a fixed position during successive lateral stitching operations; and means for maintaining the cloth in a continuous tensioned condition during the advancing and the stopping of the cloth;

each needle having a blade with an eye, and being mounted in the needle frame and its longitudinal axis turned so that the blade forms an angle of between 15° and 45° with a vertical plane in the direction of advance of the cloth, and the hooks being mounted on the hook frame so that linear movement of each hook forms an angle equal to that of the needle with which the hook cooperates.

2. The tufting device of claim 1 wherein the needles are oriented horizontally and the cloth is let off vertically.

* * * * *